US007811948B2

(12) United States Patent
Shannon et al.

(10) Patent No.: US 7,811,948 B2
(45) Date of Patent: Oct. 12, 2010

(54) TISSUE SHEETS CONTAINING MULTIPLE POLYSILOXANES AND HAVING REGIONS OF VARYING HYDROPHOBICITY

(75) Inventors: Thomas Gerard Shannon, Neenah, WI (US); Matthew Edmund Higgins, Augusta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1157 days.

(21) Appl. No.: 10/741,036

(22) Filed: Dec. 19, 2003

(65) Prior Publication Data

US 2005/0136759 A1 Jun. 23, 2005

(51) Int. Cl.
*B32B 27/12* (2006.01)
*B32B 27/04* (2006.01)

(52) U.S. Cl. ..... 442/64; 442/79; 442/86; 442/118; 428/153; 428/195; 428/211

(58) Field of Classification Search ..... 442/64, 442/79, 86, 118; 428/195, 153, 211
See application file for complete search history.

(56) References Cited

U.S. PATENT DOCUMENTS

| | | | |
|---|---|---|---|
| 2,757,150 | A | 7/1956 | Heritage |
| 3,224,926 | A | 12/1965 | Bernardin |
| 3,241,553 | A | 3/1966 | Steiger |
| 3,440,135 | A | 4/1969 | Chung |
| 3,556,932 | A | 1/1971 | Cosica et al. |
| 3,556,933 | A | 1/1971 | Williams et al. |
| 3,700,623 | A | 10/1972 | Kelm |
| 3,772,076 | A | 11/1973 | Keim |
| 3,855,158 | A | 12/1974 | Petrovich et al. |
| 3,899,388 | A | 8/1975 | Petrovich et al. |
| 4,128,692 | A | 12/1978 | Reid |
| 4,129,528 | A | 12/1978 | Petrovich et al. |
| 4,147,586 | A | 4/1979 | Petrovich et al. |
| 4,222,921 | A | 9/1980 | Van Eenam |
| 4,297,860 | A | 11/1981 | Pacifici et al. |
| 4,303,471 | A | 12/1981 | Laursen |
| 4,357,827 | A | 11/1982 | McConnell |
| 4,425,186 | A | 1/1984 | May et al. |
| 4,432,833 | A | 2/1984 | Breese |
| 4,440,597 | A | 4/1984 | Wells et al. |
| 4,469,746 | A | 9/1984 | Weisman et al. |
| 4,508,860 | A | 4/1985 | Hawes |
| 4,514,345 | A | 4/1985 | Johnson et al. |
| 4,528,239 | A | 7/1985 | Trokhan |
| 4,529,480 | A | 7/1985 | Trokhan |
| 4,556,450 | A | 12/1985 | Chuang et al. |
| 4,584,357 | A | 4/1986 | Harding |
| 4,600,462 | A | 7/1986 | Watt |
| 4,663,220 | A | 5/1987 | Wisneski et al. |
| 4,773,110 | A | 9/1988 | Hopkins |
| 4,898,642 | A | 2/1990 | Moore et al. |
| 4,950,545 | A | 8/1990 | Walter et al. |
| 5,057,166 | A | 10/1991 | Young, Sr. et al. |
| 5,059,282 | A | 10/1991 | Ampulski et al. |
| 5,068,009 | A | 11/1991 | Jokinen et al. |
| 5,071,675 | A | 12/1991 | Gupta et al. |
| 5,098,522 | A | 3/1992 | Smurkoski et al. |
| 5,223,090 | A | 6/1993 | Klungness et al. |
| 5,226,992 | A | 7/1993 | Morman |
| 5,227,242 | A | 7/1993 | Walter et al. |
| 5,230,776 | A | 7/1993 | Andersson et al. |
| 5,246,545 | A | 9/1993 | Ampulski et al. |
| 5,260,171 | A | 11/1993 | Smurkoski et al. |
| 5,275,700 | A | 1/1994 | Trokhan |
| 5,300,192 | A | 4/1994 | Hansen et al. |
| 5,328,565 | A | 7/1994 | Rasch et al. |
| 5,334,289 | A | 8/1994 | Trokhan et al. |
| 5,338,352 | A | 8/1994 | Breneman et al. |
| 5,348,620 | A | 9/1994 | Hermans et al. |
| 5,353,521 | A | 10/1994 | Orloff |
| 5,431,786 | A | 7/1995 | Rasch et al. |
| 5,443,899 | A | 8/1995 | Barcus et al. |
| 5,489,469 | A | 2/1996 | Kobayashi et al. |
| 5,492,759 | A | 2/1996 | Eriksson et al. |
| 5,496,624 | A | 3/1996 | Stelljes, Jr. et al. |

(Continued)

FOREIGN PATENT DOCUMENTS

| | | | |
|---|---|---|---|
| CA | 2 370 380 | A1 | 10/2000 |

(Continued)

OTHER PUBLICATIONS

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

(Continued)

*Primary Examiner*—Ula C Ruddock
(74) *Attorney, Agent, or Firm*—Michael J. Sullivan; Gregory E. Croft

(57) ABSTRACT

Hydrophilic polysiloxanes and hydrophobic polysiloxanes are used in combination to provide tissues, such as facial and bath tissues, with an optimal combination of absorbency and softness. At least one of the hydrophobic and hydrophilic polysiloxanes is applied to the outer surface of the tissue product in a zoned pattern such that the absorbent rate of the tissue varies across the surface.

5 Claims, No Drawings

U.S. PATENT DOCUMENTS 5,500,277 A 3/1996 Trokhan et al.
5,501,768 A 3/1996 Hermans et al.
5,514,523 A 5/1996 Trokhan et al.
5,547,541 A 8/1996 Hansen et al.
5,554,467 A 9/1996 Trokhan et al.
5,558,873 A 9/1996 Funk et al.
5,566,724 A 10/1996 Trokhan et al.
5,598,642 A 2/1997 Orloff et al.
5,598,643 A 2/1997 Chuang et al.
5,624,790 A 4/1997 Trokhan et al.
5,628,876 A 5/1997 Ayers et al.
5,637,194 A 6/1997 Ampulski et al.
5,656,132 A 8/1997 Farrington, Jr. et al.
5,693,411 A 12/1997 Hansen et al.
5,695,868 A 12/1997 McCormack
5,772,845 A 6/1998 Farrington, Jr. et al.
5,785,813 A 7/1998 Smith et al.
5,814,188 A 9/1998 Vinson et al.
5,843,056 A 12/1998 Good et al.
5,928,470 A 7/1999 Shannon
5,935,383 A 8/1999 Sun et al.
5,981,689 A 11/1999 Mitchell et al.
5,986,166 A 11/1999 Mukaida et al.
6,054,020 A 4/2000 Goulet et al.
6,072,101 A 6/2000 Beihoffer et al.
6,087,448 A 7/2000 Mitchell et al.
6,096,169 A 8/2000 Hermans et al.
6,103,063 A 8/2000 Oriaran et al.
6,110,533 A 8/2000 Cote et al.
6,117,525 A * 9/2000 Trokhan et al. ..... 428/154
6,121,409 A 9/2000 Mitchell et al.
6,143,135 A 11/2000 Hada et al.
6,149,934 A 11/2000 Krzysik et al.
6,159,591 A 12/2000 Beihoffer et al.
6,168,852 B1 1/2001 Smith, III et al.
6,194,631 B1 2/2001 Mitchell et al.
6,222,091 B1 4/2001 Beihoffer et al.
6,224,714 B1 5/2001 Schroeder et al.
6,228,506 B1 5/2001 Hosatte et al.
6,231,719 B1 5/2001 Garvey et al.
6,235,155 B1 5/2001 Schroeder et al.
6,235,965 B1 5/2001 Beihoffer et al.
6,261,580 B1 7/2001 Lehrter et al.
6,270,893 B1 8/2001 Young, Sr. et al.
6,274,667 B1 8/2001 Shannon et al.
6,287,418 B1 9/2001 Schroeder et al.
6,300,259 B1 10/2001 Westland et al.
6,342,298 B1 1/2002 Evans et al.
6,365,667 B1 4/2002 Shannon et al.
6,376,072 B1 4/2002 Evans et al.
6,379,498 B1 4/2002 Burns et al.
6,392,116 B1 5/2002 Beihoffer et al.
6,423,183 B1 7/2002 Goulet et al.
6,432,268 B1 * 8/2002 Burghardt ..... 162/112
6,432,270 B1 8/2002 Liu et al.
6,458,343 B1 10/2002 Zeman et al.
6,461,553 B1 10/2002 Hansen et al.
6,509,512 B1 1/2003 Beihoffer et al.
6,511,580 B1 1/2003 Liu
6,514,383 B1 2/2003 Liu et al.
6,521,339 B1 2/2003 Hansen et al.
6,552,245 B1 4/2003 Roessler et al.
6,555,502 B1 4/2003 Beihoffer et al.
6,576,087 B1 6/2003 Liu
6,582,558 B1 6/2003 Liu
6,582,560 B2 6/2003 Runge et al.
6,599,393 B1 7/2003 Liu
6,599,394 B1 7/2003 Liu et al.
6,632,904 B2 10/2003 Schroeder et al.
6,896,766 B2 * 5/2005 Sarbo et al. ..... 162/112
6,916,402 B2 7/2005 Shannon et al.
6,936,136 B2 8/2005 Shannon et al.
6,949,168 B2 9/2005 Liu et al.
6,977,026 B2 12/2005 Liu et al.
7,101,460 B2 9/2006 Liu et al.
7,186,318 B2 3/2007 Liu et al.
2001/0001312 A1 5/2001 Mitchell et al.
2001/0007064 A1 7/2001 Mitchell et al.
2001/0029358 A1 10/2001 Beihoffer et al.
2001/0037100 A1 11/2001 Shanklin
2001/0044612 A1 11/2001 Beihoffer et al.
2002/0007166 A1 1/2002 Mitchell et al.
2002/0015846 A1 2/2002 Evans et al.
2002/0162243 A1 11/2002 Runge et al.
2003/0014027 A1 1/2003 Beihoffer et al.
2003/0124171 A1 7/2003 Sun et al.
2003/0131962 A1 7/2003 Lindsay et al.
2003/0208173 A1 11/2003 Lagerstedt-Eidrup et al.
2004/0023579 A1 2/2004 Kainth et al.
2004/0045687 A1 3/2004 Shannon et al.
2004/0074622 A1 4/2004 Liu et al.
2004/0084164 A1 5/2004 Shannon et al.
2004/0084165 A1 5/2004 Shannon et al.
2004/0086726 A1 5/2004 Moline et al.
2004/0100376 A1 5/2004 Lye et al.
2004/0118531 A1 6/2004 Shannon et al.
2004/0144507 A1 7/2004 Shannon et al.
2004/0163785 A1 8/2004 Shannon et al.
2004/0234804 A1 11/2004 Liu et al.
2004/0253890 A1 12/2004 Ostgard et al.
2005/0136265 A1 6/2005 Liu et al.
2005/0137547 A1 6/2005 Garnier et al.
2006/0130989 A1 6/2006 Liu et al.

FOREIGN PATENT DOCUMENTS

EP 0 192 216 B1 6/1990
EP 0 217 032 B1 2/1992
WO WO 98/19013 A1 5/1998
WO WO 99/25393 A2 5/1999
WO WO 99/25745 A1 5/1999
WO WO 99/25748 A1 5/1999
WO WO 00/56959 A1 9/2000
WO WO 00/63295 A1 10/2000
WO WO 01/49937 A1 7/2001
WO WO 02/10032 A2 2/2002
WO WO 02/34184 A1 5/2002
WO WO 02/072951 A2 9/2002
WO WO 02/77048 A2 10/2002
WO WO 02/81819 A1 10/2002
WO WO 03/018671 A1 3/2003
WO WO 03/037392 A1 5/2003
WO WO 2004/044327 A1 5/2004
WO WO 2004/050995 A1 6/2004
WO WO 2004/101684 A1 11/2004

OTHER PUBLICATIONS

TAPPI Official Test Method T 410 om-98, "Grammage of Paper and Paperboard (Weight Per Unit Area)," published by the TAPPI Press, Atlanta, Georgia, revised 1998, pp. 1-5.
TAPPI Official Test Method T 411 om-89, "Thickness (Caliper) of Paper, Paperboard, and Combined Board," published by the TAPPI Press, Atlanta, Georgia, revised 1989, pp. 1-3.
TAPPI Official Test Method T 530 pm-89, "Size Test for Paper By Ink Resistance (Hercules Method)," published by the TAPPI Press, Atlanta, Georgia, revised 1989, pp. 1-5.
Foulger, M. et al., "New Technology to Apply Starch and Other Additives," *Pulp & Paper Canada*, vol. 100, No. 2, 1999, pp. 24-25.

* cited by examiner

TISSUE SHEETS CONTAINING MULTIPLE POLYSILOXANES AND HAVING REGIONS OF VARYING HYDROPHOBICITY

BACKGROUND OF THE INVENTION

In the manufacture of various tissue products, especially facial and bath tissue, it is well known to add polysiloxanes to the surface of the tissue to improve the topical surface feel of the product. Since polysiloxanes, and in particular polydialkysiloxanes such as polydimethylsiloxane are inherently hydrophobic, use of polydimethylsiloxanes can impart hydrophobicity to the tissue sheet. Modified polysiloxanes that are hydrophilic are known in the art and have also been applied to tissue substrates. It is also known to control the wet out characteristics of the sheet by blending hydrophilic and hydrophobic polysiloxanes. In general, hydrophobic polysiloxanes are more effective than hydrophilic polysiloxanes at improving softness. Also, hydrophobicity in tissue can be advantageous to provide barrier properties to the tissue to help "keep hands dry". However, balancing the need for softness and absorbency with the need for barrier protection is challenging. Recent attempts have investigated off-set zoned applications of hydrophobic polysiloxanes. Other patterned applications are described in the art. However, such patterning is done at the expense of softness as it is found that a continuous distribution of silicone across the surface generally gives better softness vs. a macroscopically discontinuous application of the silicone.

Therefore, there is a need to produce tissue products having a macroscopically continuous level of polysiloxane for softness, yet have regions of hydrophobicity within the tissue so as to maintain "keeps hands dry" characteristics. Additionally, it is preferred that these tissue products have a rapid fluid intake.

SUMMARY OF THE INVENTION

It has now been discovered that an improved balance of softness and absorbency for a tissue product can be attained by incorporating into the product two or more polysiloxanes having differing hydrophilicity and hydrophobicity characteristics. The resulting tissue product exhibits sufficient, but non-uniform, absorbency across its surface, yet exhibits a high degree of softness.

Hence, in one aspect, the invention resides in a tissue product comprising a hydrophilic polysiloxane and a hydrophobic polysiloxane, at least one of which is positioned within the product in a zoned pattern such that the absorbent rate varies across at least one outer surface of the product.

In another aspect, the invention resides in a method of making a tissue product comprising incorporating into the product a hydrophilic polysiloxane and a hydrophobic polysiloxane such that the hydrophilic polysiloxane and the hydrophobic polysiloxane are distributed differently within the product.

As used herein, the term "zoned pattern" refers to a macroscopically discernable variation in the distribution of the polysiloxane within an outer surface or ply of the tissue product. The variation can be regular or irregular and can be due to the placement or the variable concentration of the polysiloxane. Typical zoned patterns include multiple macroscopic elements such as straight or curvilinear stripes and/or completely distinct spaced-apart elements such as dots, squares, hexagons or other shapes of a macroscopic size. As a point of reference, the size of such distinct spaced-apart elements is generally about 1 square millimeter or greater, more suitably about 2 square millimeters or greater, and still more specifically about 4 square millimeters or greater. By their nature, the areas of any stripes will typically be much greater. Advantageously, all of these zoned pattern elements can be produced by gravure printing, where each zoned pattern element is an aggregate of many small (microscopic) deposits as are produced by gravure printing cells, which commonly have a cell concentration of hundreds per square inch. Accordingly, for a tissue product of this invention having polysiloxane "A" and polysiloxane "B", for example, a number of different combinations are possible. For example, "A" can be present uniformly over the entire surface of the product or ply, while "B" can be present in the form of a zoned pattern. Alternatively, both "A" and "B" can be present in a zoned pattern, which can be the same or different. If the patterns are the same, they must be positioned within the tissue differently such that they do not completely coincide. By way of example, "A" could be present in the form of stripes, while "B" could be present in the form of distinct spaced-apart elements. Alternatively, "A" could be present in the form of distinct spaced-apart elements, while "B" could also be present in the form of distinct spaced-apart elements, but of a different size and/or spacing. As will be described below, the presence or absence of a zoned pattern in accordance with this invention can be detected by the Ten Water Drop Test.

Polysiloxane uniformity in the x-y direction of the tissue sheet and/or tissue product can be determined using Micro-XRF imaging techniques. One suitable instrument for determining the x-y polysiloxane distribution is the Omnicron EDXRF system available from ThermoNoran, Inc., located in Madison, Wis. This technique enables the entirety of the tissue sheet surface to be examined for polysiloxane content.

Products of this invention can be single-ply, two-ply, three-ply, four-ply or more. Regardless of the number of plies, the products contain only two outer (outwardly-facing during use) surfaces. Each of the plies can be layered (two layers, three layers, four layers or more) or homogeneous. The hydrophilic and hydrophobic polysiloxanes can be positioned in any combination or pattern in one or more of the layers or plies, except they cannot be applied only as a simple blend or only in an identical deposit pattern. Otherwise the absorbent rate will not vary across either of the two outer surfaces of the product. It must be noted that the absorbent rate exhibited by the two outer surfaces of the product can be affected by the presence of polysiloxanes in inner plies or layers.

As used herein, a "hydrophobic" polysiloxane is a polysiloxane that, when uniformly topically sprayed onto the surface of a tissue sheet having a basis weight of 20 grams per square meter in an amount of 0.8 weight percent silicone solids based on the dry fiber weight, produces a sheet having a wet out time of 30 seconds or greater, as determined by the Single Water Drop Test (hereinafter defined) after the resulting sheet has been aged at 130° F. for a period of two weeks.

As used herein, a "hydrophilic" polysiloxane is a polysiloxane that, when uniformly topically sprayed onto the surface of a tissue sheet having a basis weight of 20 grams per square meter in an amount of 0.8 weight percent silicone solids based on the dry fiber weight, produces a sheet having a wet out time of less than 30 seconds, as determined by the Single Water Drop Test (hereinafter defined) after the resulting sheet has been aged at 130° F. for a period of two weeks.

As used herein, the term "positioned differently" or "distributed differently" means that there is a difference between one area of the sheet as compared to another area of the sheet with respect to the presence and/or concentration of the different polysiloxanes. This difference enables the surface of the tissue sheet to be substantially covered with polysiloxane, yet because a hydrophilic polysiloxane exists or is more prevalent in some areas, the absorbency is enhanced in those areas compared to areas where only a hydrophobic polysiloxane is present. This difference in position can be accomplished a number of different ways. By way of example, without limitation:

(a) the hydrophobic polysiloxane can be printed or sprayed onto one or both outer surfaces of the tissue sheet in one pattern and the hydrophilic polysiloxane can be printed or sprayed onto one or both outer surfaces of the tissue sheet in a different pattern;

(b) the hydrophobic polysiloxane can be applied to the fibers prior to forming the sheet and the hydrophilic polysiloxane can be sprayed or printed on one or both outer surfaces of the sheet in a pattern;

(c) the hydrophilic polysiloxane can be applied to the fibers prior to forming the sheet and the hydrophobic polysiloxane can be sprayed or printed on one or both outer surfaces of the sheet in a pattern; or (d) the hydrophobic polysiloxane can be applied to one side of the sheet and the hydrophilic polysiloxane can be applied to the opposite side of the sheet, where either or both applications can be in a pattern or uniformly overall.

In one specific embodiment of the invention, one surface of the tissue is treated with a hydrophilic polysiloxane, uniformly or nonuniformly overall or in a pattern, followed by a second application of a hydrophobic polysiloxane in a striped zoned pattern. The resulting product has a macroscopically complete coverage with a hydrophilic polysiloxane across the surface of the tissue, yet has regions of hydrophobicity that impede flow of fluids through the product in those regions, yet overall fluid flow into the product is not significantly impeded.

In another embodiment of the invention, the hydrophilic and hydrophobic regions of the sheet are arranged in an offset striped pattern whereby the striped hydrophilic regions are directly opposite from the striped hydrophobic regions of the nearest adjacent ply. Particularly for offset applications where a strikethrough prevention benefit is desired, it is advantageous that the percent of the sheet surface area occupied by the hydrophobic region be, about 50 percent or greater, more specifically about 60 percent or greater, still more specifically about 70 percent or greater, and still more specifically from about 50 to about 95 percent.

In another embodiment of the invention, the treated tissue is aged at elevated temperature for a period of time sufficient to increase the hydrophobicity in areas treated with the hydrophobic polysiloxane, yet the regions where the hydrophilic polysiloxane is present are little affected by the heat aging. Hydrophobic polysiloxanes demonstrate a time/temperature sensitivity whereby the hydrophobicity of the sheet increases significantly with time and increasing temperature. On the other hand, hydrophilic polysiloxanes, particularly the amino functional co-polyether polysiloxanes such as Wetsoft® CTW, are found not to increase significantly in hydrophobicity with increasing time/temperature. Interestingly, when the hydrophilic Wetsoft® CTW is applied in combination with a hydrophobic polysiloxane, the area treated with the Wetsoft® CTW takes on the hydrophilic characteristics of the Wetsoft® CTW and not the hydrophobic characteristics of the hydrophobic polysiloxane.

In another specific embodiment of the invention, the hydrophobic polysiloxane is applied to the pulp fibers at the pulp mill with the hydrophilic polysiloxane being applied topically to one or both outer surfaces of the tissue product after the tissue making process. In an alternative embodiment the hydrophilic polysiloxane is applied to the pulp fibers at the pulp mill and the hydrophobic polysiloxane is applied topically to one or both outer surfaces of the tissue product after the tissue making process. The application of hydrophobic polysiloxanes to pulp fibers at a pulp mill is described in U.S. Pat. No. 6,582,560, issued on Jun. 24, 2003 to Runge, et. al. and which is incorporated by reference to the extent that it is non-contradictory herewith.

While not wishing to be bound by theory, the softness benefits that the hydrophilic and hydrophobic polysiloxanes deliver to cellulose fiber-containing tissue sheets or tissue products are believed to be, in part, related to the molecular weight of the polysiloxanes. Viscosity is often used as an indication of molecular weight of polysiloxanes since exact number or weight average molecular weights of polysiloxanes are often difficult to determine. The viscosity of the both the hydrophobic and hydrophilic polysiloxanes useful in the present invention can be about 25 centipoise or greater, more specifically about 50 centipoise or greater, and still more specifically about 100 centipoise or greater. The term "viscosity" as referred to herein refers to the viscosity of the neat polysiloxane itself and not to the viscosity of an emulsion if so delivered. The polysiloxanes of the present invention may be delivered as solutions containing diluents. Such diluents may lower the viscosity of the polysiloxane solution below the limitations set above, however, the efficacious part of the polysiloxane should conform to the viscosity ranges given above. Examples of such diluents include, but are not limited to, oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these compounds.

The amount of either the hydrophilic or hydrophobic polysiloxane solids in the product relative to the total dry fiber weight in the product can be from about 0.1 to about 5 weight percent or greater, more specifically from about 0.5 to about 4 weight percent, and still more specifically from about 0.5 to about 3 weight percent. The means for applying the polysiloxanes to the sheet can be accomplished by any method known in the art for applying materials to a paper sheet including, without limitation, gravure printing, blade coating and spraying.

The hydrophilic polysiloxanes useful for purposes of this invention can be any polysiloxane that imparts sufficient hydrophilicity to the sheet. One exemplary class of functionalized polysiloxanes is the polyether polysiloxanes. Such polysiloxanes are known and are usually incorporated wholly or in part with other functional polysiloxanes as a means of improving hydrophilicity of the silicone treated tissue sheet or tissue product. Hydrophilic polysiloxanes can generally have the following structure:

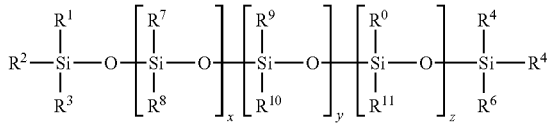

wherein "x" and "z" are integers >0 and "y" is an integer ≧0. The mole ratio of x to (x+y+z) can be from about 0.001 to about 0.95. The ratio of y to (x+y+z) can be from 0 to about 0.25. The $R^0$-$R^9$ moieties can independently be any organo-functional group including $C_1$ or higher alkyl groups, ethers, polyethers, polyesters, amines, imines, amides, or other functional groups including the alkyl and alkenyl analogues of such groups. The $R^{10}$ moiety is an amino functional moiety including, but not limited to, primary amine, secondary amine, tertiary amines, quaternary amines, unsubstituted amides and mixtures thereof. An exemplary $R^{10}$ moiety contains one amine group per constituent or two or more amine groups per substituent, separated by a linear or branched alkyl chain of $C_1$ or greater. $R^{11}$ is a polyether functional group having the generic formula: $—R^{12}—(R^{13}—O)_a—(R^{14}—O)_b—R^{15}$, wherein $R^{12}$, $R^{13}$, and $R^{14}$ are independently $C_{1-4}$ alkyl groups, linear or branched; $R^{15}$ may be H or a $C_{1-30}$ alkyl group; and, "a" and "b" are integers of from about 1 to about 100, more specifically from about 5 to about 30. Exemplary amino-functional hydrophilic polysiloxanes are the Wetsoft® CTW family manufactured and sold by Wacker, Inc. Other exemplary hydrophilic polysiloxanes are disclosed in U.S. Pat. No. 6,432,270, issued on Aug. 13, 2002 to Liu et al. herein incorporated by reference. Hydrophilic polysiloxanes advantageously are amino-functional, co-polyether polysiloxanes.

The hydrophobic polysiloxanes useful for purposes of this invention are any hydrophobic polysiloxanes that deliver the required softness and hydrophobicity properties to the area of the sheet in which they are positioned. A specific class of suitable hydrophobic polysiloxanes is the so called polydialkylsiloxanes having a general formula:

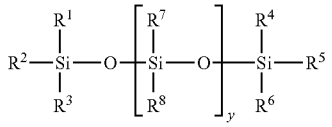

wherein the $R^1$-$R^8$ moieties can independently be any hydrophobic organo-functional group including $C_1$ or higher alkyl groups, ethers, polyethers, polyesters, amines, imines, amides, or other functional groups including the alkyl and alkenyl analogues of such groups and "y" is an integer >1. Specifically, the $R^1$-$R^8$ moieties are independently any $C_1$ or higher alkyl group including mixtures of the alkyl groups. Exemplary fluids are the DC-200® (fluid series, and HMW 2200® manufactured and sold by Dow Corning, Inc.

A particularly suitable class of hydrophobic polysiloxanes is the so-called amino-functional polysiloxanes having the general structure:

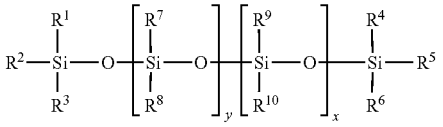

wherein "x" and "y" are integers >0. The mole ratio of x to (x+y) can be from about 0.001 to about 0.25. The $R^1$-$R^9$ moieties can independently be any $C_1$ or higher alkyl groups, substituted alkyl groups and the alkenyl analogues of such groups. The $R^{10}$ moiety is an amino-functional moiety including, but not limited to, primary amine, secondary amine, tertiary amines, quaternary amines, unsubstituted amides, and mixtures thereof. An exemplary $R^{10}$ moiety contains one amine group per constituent or two or more amine groups per substituent, separated by a linear or branched alkyl chain of $C_1$ or greater. Such materials are broadly known in the art and readily available commercially. Examples of suitable hydrophobic polysiloxanes include Y-14344 available from GE/OSi Silicones, Waterford, N.Y. and DC 2-8175, DC 3-8220, DC-8129 available from Dow Corning, Midland, Mich.

Either of the polysiloxanes can be delivered as aqueous dispersions or emulsions, including microemulsions, stabilized by suitable surfactant systems that may confer a charge to the emulsion micelles. Nonionic, cationic, and anionic polysiloxane materials can be used. The polysiloxanes can also be delivered as neat fluids.

The finished tissue products of the invention may contain any number of additives known to those skilled in the art. This list would include wet and dry strength additives, retention aids, debonders, skin wellness additives such as Aloe Vera extract and tocopherols such as vitamin E, fillers such as Kaolin clay, deodorizers such as cyclodextrins, antiviral and antibacterial agents, etc. These additives may be applied at any point in the process including simultaneously with either of the polysiloxanes.

The tissue products of this invention can be further characterized by their absorbent rate and strike-through properties as measured by the Automatic Gravimetric Absorbency Test (AGAT) (hereinafter defined) and the Hercules Size Test (HST) (hereinafter defined), respectively. More particularly, the tissue products of this invention can have an AGAT value of about 0.6 or greater $g/g/s^{1/2}$, more specifically about 0.8 or greater $g/g/s^{1/2}$, and still more specifically about 1.0 or greater $g/g/s^{1/2}$. The tissue products of this invention can also have HST values of about 4 seconds or greater, more specifically about 6 seconds or greater, and still more specifically about 8 seconds or greater.

The "Hercules Size Test" (HST) is a test that generally measures how long it takes for a liquid to travel through a tissue product (strike-through). Hercules Size Testing is done in general accordance with TAPPI method T 530 PM-89, Size Test for Paper with Ink Resistance using a Model HST tester with white and green calibration tiles and the black disk provided by the manufacturer. A 2% Napthol Green N dye diluted with distilled water to 1% is used as the dye. All materials are available from Hercules, Inc., Wilmington, Del.

All specimens are aged at 130° F. for 2 weeks and conditioned for at least 4 hours at 23+/1 1° C. and 50+/−2% relative humidity prior to testing. The test is sensitive to dye solution temperature so the dye solution should also be equilibrated to the controlled condition temperature for a minimum of 4 hours before testing. Six representative tissue products are selected for testing and stacked together to form the test specimen. Specimens are cut to an approximate dimension of 2.5×2.5 inches. The instrument is standardized with white and green calibration tiles per manufacturer's directions. The specimen is placed in the sample holder with the outer surface of the plies facing outward. The specimen is then clamped into the specimen holder. The specimen holder is then positioned in the retaining ring on top of the optical housing. Using the black disk the instrument zero is calibrated. The black disk is removed and 10+/−0.5 milliliters of dye solution is dispensed into the retaining ring and the timer started while placing the black disk back over the specimen. The test time in seconds is the HST value for the product.

The "Automatic Gravimetric Absorbency Test" (AGAT) is a test that generally measures the initial absorbency of a tissue sheet which has been aged for 2 weeks at 130° F. The apparatus and test are well known in the art and are described in U.S. Pat. No. 4,357,827 entitled Gravimetric absorbency tester and issued Nov. 9, 1982 to McConnell, which is incorporated herein by reference. In general, the AGAT value is determined by testing a stack of six representative samples of a tissue product. During testing, the sample stack is placed on the test cell that is in communication with the reservoir vessel. A valve is then opened so that liquid is free to flow from the vessel to the test cell. The stack of tissues being tested absorbs liquid from the reservoir vessel. The amount of liquid taken up by the stack is determined over a period of time. In particular, the AGAT machine generates an absorption curve from 2.25 seconds to as long as desired. The AGAT result is obtained by measuring the average slope from between 2.25 and 6.25 seconds. Ten replicates are run for each product and the average of the 10 replicates is the AGAT value for that product.

The "Single Water Drop Test" is used to determine if a material is hydrophobic or hydrophilic. (Alternatively, the Single Water Drop Test can be used to measure the hydrophobicity or hydrophilicity of a particular area of a tissue product when the hydrophilic and hydrophobic areas can be ascertained via a visual or other method.) To carry out the Single Water Drop Test for determining the hydrophilicity or hydrophobicity of a material, an aged test sheet is prepared as previously described by aging the samples at 130° F. for 2 weeks. The aged test sheet is then conditioned at 23.0° C.±1.0° C. and 50.0%±2.0% relative humidity for a period of at least 4 hours immediately prior to testing. The conditioned test sample is then placed on a dry glass plate. A single drop (100 microliters, 0.1±0.01 ml.) of distilled water (23.0° C.±1.0° C.) is dispensed from an Eppendorf style pipet positioned slightly above the surface of the test specimen. The drop should be positioned close to the center of the test specimen. The water drop is viewed by the naked eye on a plane horizontal to the surface of the test specimen. A stopwatch is started immediately after the water drop is dispensed onto the test specimen. The elapsed time for the water drop to be completely absorbed by the sample, measured in seconds, is the Single Water Drop Test value (wet out time) for that test specimen. The water drop is completely absorbed when it completely disappears, that is, there is no visible vertical element of the water drop remaining. To determine the Single Water Drop Test value for any given material, the foregoing procedure is carried out on three representative aged sheets and the average value from the three tests is the Single Water Drop Test value for the material. If, after 3 minutes, the water drop is not completely absorbed, the test is stopped and the Single Water Drop Test value is assigned a value of 180 seconds. As previously stated, hydrophobic materials will have a Single Water Drop Test value of 30 seconds or greater, while hydrophilic materials will have a Single Water Drop Test value of less than 30 seconds.

The "Ten Water Drop Test" is used to determine if the absorbent rate varies across a surface of a tissue product. To carry out the test, the test product is first aged at 130° F. for a period of two weeks and then conditioned at 23.0° C.±1.0° C. and 50.0%±2.0% relative humidity for a period of at least 4 hours immediately prior to testing. The conditioned test sample is then placed on a dry glass plate. A single drop (100 microliters, 0.1±0.01 ml.) of distilled water (23.0° C.±1.0° C.) is dispensed from an Eppendorf style pipet positioned slightly above the surface of the test specimen at ten (10) random locations on the exposed surface of the product. The ten drops are observed and timed as described above for the Single Water Drop Test. If the time taken for any drop to be completely absorbed differs by 20 seconds or more from the time taken for any other drop to be completely absorbed, then for purposes herein there is variability in the absorbent rate across the surface of the product being tested. If the drops spread horizontally on the sheet to the extent that ten (10) drops cannot be placed without overlapping each other, additional representative product specimens will have to be tested so that the required number of a total of ten drops can be placed and timed.

For purposes of this invention, when carrying out the Ten Water Drop Test, it is advantageous if the lowest Ten Water Drop Test value is about 30 seconds or less, more specifically about 20 seconds or less, and still more specifically about 10 seconds or less, indicating a high degree of hydrophilicity for that area of the product. At the same time, it is advantageous if the highest Ten Water Drop Test value is about 40 seconds or greater, more specifically about 60 seconds or greater, and still more specifically about 90 seconds or greater, indicating a high degree of hydrophobicity for that area of the product.

EXAMPLE

Example 1. (Comparative)

This example illustrates the preparation of a tissue product comprising a hydrophobic polysiloxane applied in a zoned pattern to both outer surfaces of the product. The tissue product contained three plies, each ply having a bone dry basis weight of approximately 13.1 gsm. Each ply contained 20 percent by weight broke. Each ply was made from a stratified fiber furnish including two outer layers and a middle layer. The first outer layer comprised 40 percent by weight of the ply and contained 100 percent eucalyptus fibers. The middle layer comprised 30 percent by weight of the ply and contained a mixture of softwood fibers, eucalyptus fibers, and broke. The second outer layer also comprised 30 percent by weight of the ply and also contained a mixture of softwood fibers, eucalyptus fibers, and broke. The overall ratio of eucalyptus fibers to softwood fibers was 70 to 30.

The three-ply tissue product was then printed on both sides with a hydrophobic polysiloxane aqueous emulsion (Y-14, 344 manufactured by GE/OSi Silicones, located in Waterford, N.Y.) in a zoned pattern via a simultaneous rotogravure printing process. The gravure rolls were electronically engraved, chrome-over-copper rolls supplied by Southern Graphics Systems, located at Louisville, Ky. The rolls had a line screen of 360 cells per lineal inch and a volume of 1.5 billion cubic microns (BCM) per square inch of roll surface. Typical cell dimensions for this roll were 65 microns in length, 110 microns in width, and 13 microns in depth. The rubber backing offset applicator rolls were a 75 Shore A durometer cast polyurethane supplied by American Roller Company, located at Union Grove, Wis. The process was set up to a condition having 0.375 inch interference between the gravure rolls and the rubber backing rolls and 0.003 inch clearance between the facing rubber backing rolls. The simultaneous offset/offset gravure printer was run at a speed of 2000 feet per minute. This process yielded an add-on level of 1.0 weight percent hydrophobic polysiloxane total add-on based on the weight of the three-ply tissue product. The resulting product had a Single Water Drop Test value, after aging at 130° F. for two weeks, of 50 seconds or greater at all locations on the sheet, an HST value of 88 seconds and an AGAT value of 0.1 $g/g/s^{1/2}$

Example 2. (Invention)

This example illustrates a tissue product made in accordance with this invention, wherein a hydrophobic polysiloxane was applied to both outer surfaces of the tissue product in fine zoned pattern of small dots. Thereafter, a hydrophilic polysiloxane was applied to both outer surfaces in a striped pattern, thereby providing macroscopic overall coverage for purposes of surface softness while providing variable absorbent rates across the surface of the product for acceptable absorbency.

Specifically, a hydrophobic three-ply facial tissue was made as described in Example 1, except the hydrophobic polysiloxane was OSi Y-14344 applied at an add-on of 1.5 weight percent. Thereafter, 5 grams of a hydrophilic polysiloxane (Wetsoft® CTW fluid (100% active) available from Kelmar Industries, Duncan, S.C. and having a viscosity of about 5000 cps at 25° C.) was mixed well with 100 cc of distilled water to form a stable dispersion of the polysiloxane in water. Wetsoft® CTW is self-emulsifiable in water and contained no added surfactants. The polysiloxane/water emulsion was then applied in a striped pattern to both outer surfaces of the tissue. The hydrophilic polysiloxane was applied to the sheet as a spray using a striping template laid across the sheet to form treated and untreated regions. The stripes were 0.25 inch wide running in the machine direction of the sheet. The add-on amount of the hydrophilic polysiloxane solids was about 0.19 $g/m^2$ in the treated regions (0.06 $g/m^2$ total sheet). The hydrophilic polysiloxane treated regions were spaced 0.5 inch apart from edge to edge such that the product had alternating 0.25 inch hydrophilic and 0.5 inch hydrophobic striped regions. The tissue product was then placed in an oven to dry for 2 hours at 85° C. The area treated with the Wetsoft® CTW on top of the overall base hydrophobic polysiloxane treatment was found to have a Single Water Drop Test value of about 7 seconds and allowed for rapid intake of the water while the hydrophobic striped regions had a Single Water Drop Test value in excess of 3 minutes.

Example 3. (Invention)

This example demonstrates the application of the hydrophilic polysiloxane in an "offset" striped zoned pattern. In the offset striped zone pattern, the center of the hydrophilic pattern on one side of the sheet is located at the center point of the hydrophobic pattern directly opposite on the other side of the tissue sheet, such that looking in the z-direction of the product, a hydrophilic stripe on one outer surface of the product is aligned with a hydrophobic stripe on the other side of the product. This arrangement inhibits "strike-through" of liquid from one side of the product to the other. As a result, the tissue product of this example has macroscopically complete polysiloxane surface coverage in the x-y plane on both exterior surfaces of the three-ply tissue product for purposes of generating a soft feel. However, the product also has macroscopically discontinuous hydrophobic regions in the cross direction of the tissue sheet.

More specifically, the hydrophobic three-ply tissue product of Example 1 is provided to a second printing station. A hydrophilic polysiloxane emulsion (Wetsoft 1967E, base polysiloxane Wetsoft CTW available from Kelmar Industries, Duncan, S.C.) is applied to the tissue product using a patterned gravure print roll in an offset stripe pattern on opposite sides of the sheet. The total macroscopic surface area coverage of hydrophilic polysiloxane on each side of the sheet was 10 percent. The width of the macroscopically discontinuous hydrophobic regions was 2 cm. The width of macroscopically discontinuous hydrophilic regions was 0.22 cm. The amount of offset was 0.89 cm (the amount of offset is one-half the difference between the width of the hydrophobic columns and the width of the hydrophilic columns). The hydrophilic polysiloxane application rate was 1.0% by weight dry fibers in the application area (0.391 g/m2) or 0.1% by weight of total fiber in sheet (0.0391 g/m2).

After aging 2 weeks at 130° F., the tissue product had a Single Water Drop Test value in the hydrophobic regions of 55 seconds and a Single Water Drop Test test value in the hydrophilic regions of 6 seconds. The tissue sheet had an HST value of 8 seconds and an AGAT value of 0.8 $g/g/s^{1/2}$. The tissue product had a total polysiloxane content of 1.1% by weight of total fibers and a polydialkylsiloxane content of 0.9% by weight of total dry fibers.

It will be appreciated that the foregoing examples and description are for purposes of illustration and are not to be construed as limiting the scope of the invention, which is defined by the following claims and all equivalents thereto.

We claim:

1. A tissue product comprising one or more plies of cellulose papermaking fibers and having two outer surfaces, said product further comprising a hydrophilic polysiloxane and a hydrophobic polysiloxane, at least one of which is positioned within the product in a zoned pattern having a macroscopically discernable variation in the distribution of said at least one polysiloxane such that the absorbent rate varies across at least one outer surface of the product as determined by the Ten Water Drop Test, wherein the hydrophilic polysiloxane is uniformly distributed on at least one outer surface of the product and the hydrophobic polysiloxane is distributed in a macroscopically zoned pattern on the same surface of the product.

2. A tissue product comprising one or more plies of cellulose papermaking fibers and having two outer surfaces, said product further comprising a hydrophilic polysiloxane and a hydrophobic polysiloxane, at least one of which is positioned within the product in a zoned pattern having a macroscopically discernable variation in the distribution of said at least one polysiloxane such that the absorbent rate varies across at least one outer surface of the product as determined by the Ten Water Drop Test, wherein the hydrophobic polysiloxane is uniformly distributed on at least one outer surface of the product and the hydrophilic polysiloxane is distributed in a macroscopically zoned pattern on the same surface of the product.

3. A tissue product comprising one or more plies of cellulose papermaking fibers and having two outer surfaces, said product further comprising a hydrophilic polysiloxane and a hydrophobic polysiloxane, at least one of which is positioned within the product in a zoned pattern having a macroscopically discernable variation in the distribution of said at least one polysiloxane such that the absorbent rate varies across at least one outer surface of the product as determined by the Ten Water Drop Test, wherein both the hydrophobic polysiloxane and the hydrophilic polysiloxane are positioned on one or both outer surfaces in striped patterns, and further wherein the hydrophilic polysiloxane stripes are offset from the hydrophobic polysiloxane stripes.

4. A tissue product comprising one or more plies of cellulose papermaking fibers and having two outer surfaces, said product further comprising a hydrophilic polysiloxane and a hydrophobic polysiloxane, at least one of which is positioned within the product in a zoned pattern having a macroscopically discernable variation in the distribution of said at least one polysiloxane such that the absorbent rate varies across at least one outer surface of the product as determined by the Ten Water Drop Test, wherein the hydrophilic polysiloxane is distributed in a dot pattern and the hydrophilic polysiloxane is distributed in a stripe pattern.

5. A tissue product comprising one or more plies of cellulose papermaking fibers and having two outer surfaces, said product further comprising a hydrophilic polysiloxane and a hydrophobic polysiloxane, at least one of which is positioned within the product in a zoned pattern having a macroscopically discernable variation in the distribution of said at least one polysiloxane such that the absorbent rate varies across at least one outer surface of the product as determined by the Ten Water Drop Test, wherein the hydrophilic polysiloxane is distributed in a stripe pattern and the hydrophobic polysiloxane is distributed in a distinct spaced-apart element pattern.

* * * * *